US005345617A

United States Patent [19]

Jahner et al.

[11] Patent Number: 5,345,617

[45] Date of Patent: Sep. 13, 1994

[54] TOILET SEAT AIR FRESHENER

[76] Inventors: James F. Jahner; Gust A. Jahner; Frank E. Jahner, all of 2442 Pioneer Way E, Tacoma, Wash. 98404

[21] Appl. No.: 151,000

[22] Filed: Nov. 12, 1993

[51] Int. Cl.[5] ..... A47K 13/30

[52] U.S. Cl. ..... 4/217; 4/DIG. 6

[58] Field of Search ..... 4/213, 216, 217, 347, 4/352, DIG. 6

[56] References Cited

U.S. PATENT DOCUMENTS

| | | | |
|---|---|---|---|
| 929,079 | 7/1909 | Cresse | 4/DIG. 6 |
| 1,997,695 | 4/1935 | Nielsen et al. | 4/213 |
| 3,999,225 | 12/1976 | Ables | 4/217 X |
| 4,071,915 | 2/1978 | Kurataro | 4/217 |

FOREIGN PATENT DOCUMENTS

| | | | |
|---|---|---|---|
| 0471073 | 1/1929 | Fed. Rep. of Germany | 4/217 |
| 9106717 | 5/1991 | World Int. Prop. O. | 4/217 |

*Primary Examiner*—Charles E. Phillips

[57] ABSTRACT

A toilet seat assembly for drawing in noxious toilet air, filtering and freshening the air, and returning the treated air to the toilet area. The toilet seat includes internally formed intake and exhaust ports which are each provided with respective intake and exhaust apertures. The intake apertures are arranged around the inner periphery of the seat to point towards the center of the toilet and the exhaust apertures are arranged around the outer periphery of the seat. An air treatment assembly is connected to the ports and is operable to draw air in through the intake apertures, pass the air through both a charcoal filter and a deodorant filter, and exhaust the air through the exhaust apertures in the toilet seat. An alternate embodiment of the present invention includes a heater assembly to warm the air prior to its exhaust.

7 Claims, 4 Drawing Sheets

FIG. 1
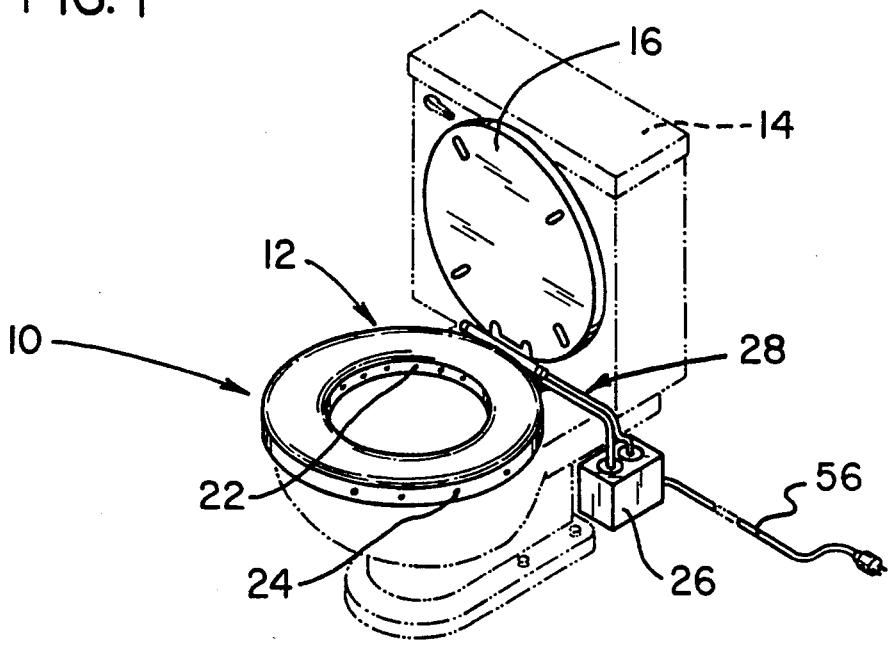
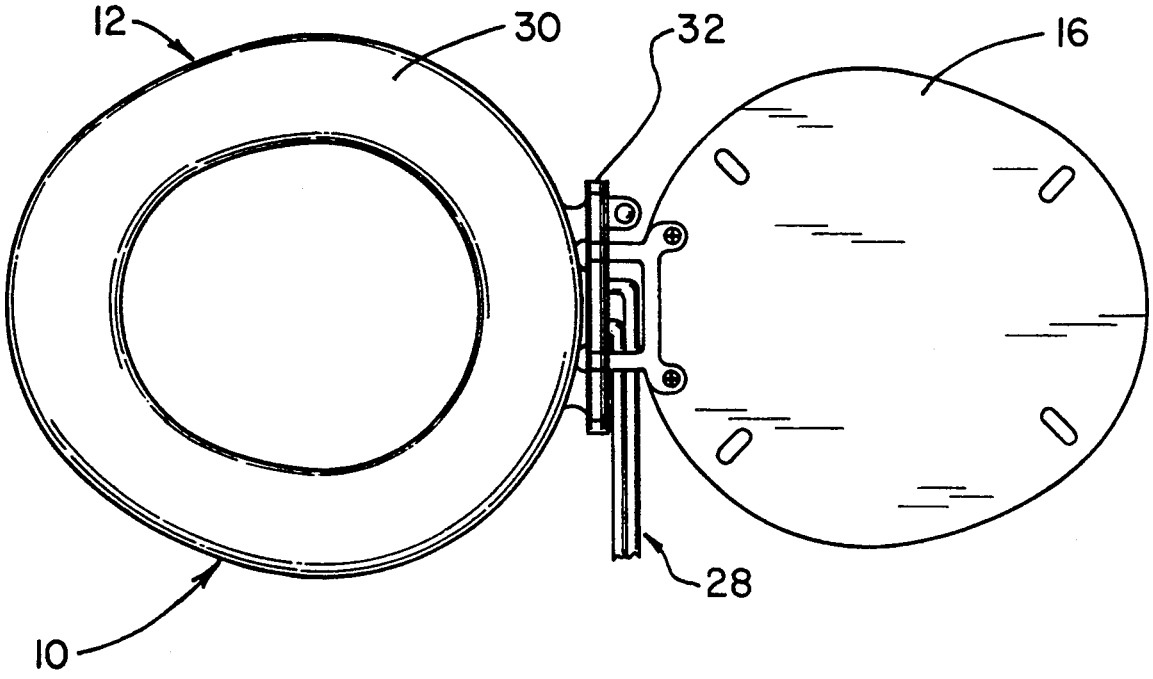
FIG. 2

TOILET SEAT AIR FRESHENER

BACKGROUND OF THE INVENTION

1. Field of the Invention

The present invention relates to air fresheners and more particularly pertains to a toilet seat air freshener for drawing in noxious air, filtering and freshening the air, and returning the treated air to the toilet area.

2. Description of the Prior Art

The use of air fresheners is known in the prior art. More specifically, air fresheners heretofore devised and utilized for the purpose of removing noxious toilet air are known to consist basically of familiar, expected and obvious structural configurations, notwithstanding the myriad of designs encompassed by the crowded prior art which have been developed for the fulfillment of countless objectives and requirements.

In the past, toilet venting systems have been devised to remove noxious air through the toilet bowl through various means. However, these devices typically remove the air to a location exterior of the bathroom and therefore, installation of these devices requires considerable effort. Because of such effort, the prior art toilet venting systems are typically permanently installed. Several examples of such systems are illustrated in the prior art.

For example, a toilet bowl vent system is illustrated in U.S. Pat. No. 5,209,346 which may be utilized with a toilet having a bowl and a plurality of openings disposed about its rim, and a tank to store water with a bowl filled tube interconnected with the openings. A vent is positioned above the level of maximum water storage in the tank and a low pressure region within the vent is established to bias air flow through the bowl rim openings in the toilet and also through the bowl fill tube in the toilet fill tube in the toilet tank and into the vent. Finally, an exhaust outlet is located at a remote point from the toilet in order to output the air flow from the toilet.

An R.V. toilet venting system is described in U.S. Pat. No. 5,]79,738 in which a remotely operable exhaust blower is operatively associated with the upper discharge end of the vent pipe of a recreational vehicle holding tank. The system utilizes a float-type liquid flow preventing valve which allows a downstream flow of odors and gases therethrough and prevents downstream flow of liquid under pressure therethrough.

Another patent of interest is U.S. Pat. No. 5,044,018 which discloses a toilet and device for removing unpleasant odors. The ventilation system includes a suction apparatus whose intake is connected to the upper region of the bowl above the water seal, and outlet passage whose opening communicates with the waste discharge passage of the toilet at a point below the water seal, and a valve means mounted in the outlet passage which is normally closed when the suction apparatus is inoperative. The suction apparatus and the valve means are electrically operated.

While these devices fill the respective, particular objectives and requirements, the aforementioned patents do not disclose a toilet seat assembly for drawing in noxious toilet air, filtering and freshening the air, and returning the treated air to the toilet area in which a toilet seat includes internal intake and exhaust ports, each provided with respective intake and exhaust apertures which communicate with an air treatment assembly operable to draw air in through the intake apertures, pass the air through both a charcoal filter and a deodorant filter, and exhaust the air through the exhaust apertures. Furthermore, none of the known prior art air fresheners teach or suggest an air treatment assembly which includes a heater assembly for warming the air prior to its exhaust.

In these respects, the toilet seat air freshener according to the present invention substantially departs from the conventional concepts and designs of the prior art, and in so doing provides an apparatus primarily developed for the purpose of drawing in noxious toilet air from a toilet bowl, filtering and freshening the air, and returning the treated air to the toilet area.

SUMMARY OF THE INVENTION

In view of the foregoing disadvantages inherent in the known types of air fresheners now present in the prior art, the present invention provides a new toilet seat air freshener construction wherein the same can be utilized for drawing in noxious toilet air from a toilet bowl, filtering and freshening the air, and returning the treated air to the toilet area.

As such, the general purpose of the present invention, which will be described subsequently in greater detail, is to provide a new toilet seat air freshener apparatus which has many of the advantages of the air fresheners mentioned heretofore and many novel features that result in a toilet seat air freshener which is not anticipated, rendered obvious, suggested, or even implied by any of the prior art air fresheners, either alone or in any combination thereof.

To attain this, the present invention essentially comprises a toilet seat assembly for drawing in noxious toilet air, filtering and freshening the air, and returning the treated air to the toilet area. The toilet seat includes internally formed intake and exhaust ports which are each provided with respective intake and exhaust apertures. The intake apertures are arranged around the inner periphery of the seat to point towards the center of the toilet and the exhaust apertures are arranged around the outer periphery of the seat. An air treatment assembly is connected to the ports and is operable to draw air in through the intake apertures, pass the air through both a charcoal filter and a deodorant filter, and exhaust the air through the exhaust apertures in the toilet seat. An alternate embodiment of the present invention includes a heater assembly to warm the air prior to its exhaust.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toilet seat air freshener apparatus which has many of the advantages of the air fresheners mentioned heretofore and many novel features that result in a toilet seat air freshener which is not anticipated, rendered obvious, suggested, or even implied by any of the prior art air fresheners, either alone or in any combination thereof.

It is another object of the present invention to provide a new toilet seat air freshener which may be easily and efficiently manufactured and marketed.

It is a further object of the present invention to provide a new toilet seat air freshener which is of a durable and reliable construction.

An even further object of the present invention is to provide a new toilet seat air freshener which is susceptible of a low cost of manufacture with regard to both materials and labor, and which accordingly is then susceptible of low prices of sale to the consuming public, thereby making such toilet seat air fresheners economically available to the buying public.

Still yet another object of the present invention is to provide a new toilet seat air freshener which provides in the apparatuses and methods of the prior art some of the advantages thereof, while simultaneously overcoming some of the disadvantages normally associated therewith.

Still another object of the present invention is to provide a new toilet seat air freshener for drawing in noxious toilet air from a toilet bowl, filtering and freshening the air, and returning the treated air to the toilet area.

Yet another object of the present invention is to provide a new toilet seat air freshener in which a toilet seat includes internally formed intake and exhaust ports, each provided with respective intake and exhaust apertures that communicate with an air treatment assembly operable to draw air into through the intake apertures, pass the air through both a charcoal filter and an deodorant filter, and exhaust the air through the exhaust apertures.

Even still another object of the present invention is to provide a new toilet seat air freshener which may be easily installed without a substantial modification of the associated toilet facilities.

Even still yet another object of the present invention is to provide a new toilet seat air freshener which includes a heater assembly for warming the air prior to its exhaust.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a first embodiment of a toilet seat air freshener comprising the present invention.

FIG. 2 is a top plan view of the present invention.

DESCRIPTION OF THE PREFERRED EMBODIMENT

Figure 3:
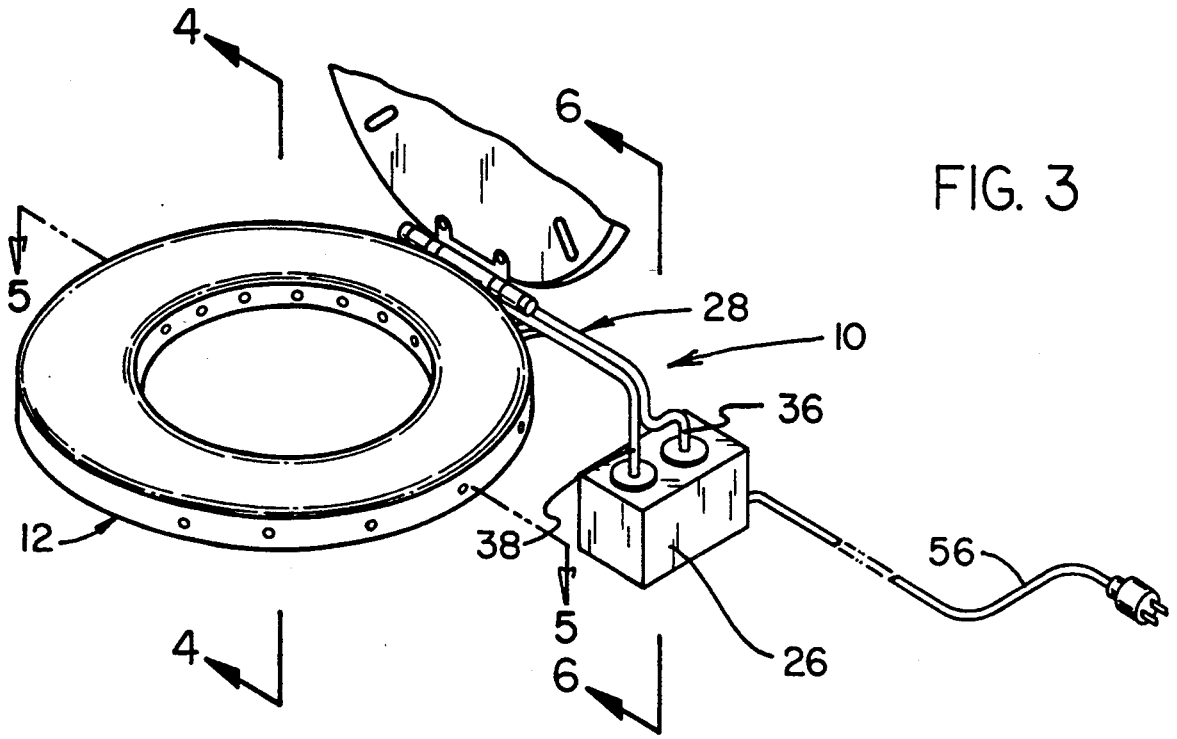
FIG. 3 is an enlarged perspective view of the invention.

With reference now to the drawings, and in particular to FIGS. 1–6 thereof, a first embodiment of a new toilet seat air freshener embodying the principles and concepts of the present invention and generally designated by the reference numeral 10 will be described.

Figure 4:
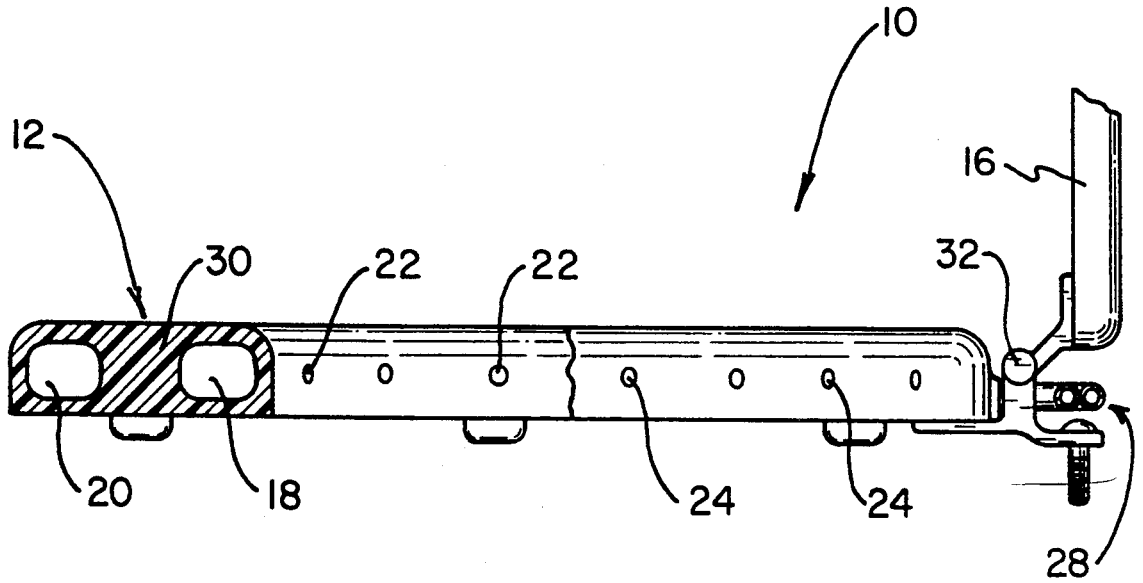
FIG. 4 is a side plan view, partially in cross section, taken along line 4—4 of FIG. 3.

From an overview standpoint, the toilet seat air freshener 10 comprises an apertured seat assembly 12 which may be installed onto a conventional toilet 14, as best illustrated in FIG. 1. A lid 16 is hingedly connected to the aperture seat assembly 12 and is operable to function as a conventional toilet seat closure. As best illustrated in FIG. 4, the apertured seat assembly 12 is provided with an intake port 18 and an exhaust port 20. Intake apertures 22 and exhaust apertures 24 are positioned around the inner and outer peripheries of the apertured seat assembly 12 and are in fluid communication with the intake port 18 and the exhaust port 20, respectively.

The ports 18, 20 communicate with an air treatment assembly 26 through a pair of air lines 28, as best illustrated in FIG. 3. The air treatment assembly 26 is operable to draw noxious toilet air in through the intake apertures 22, condition such air, and return the air through the exhaust apertures 24 to the surrounding area.

In use, the toilet seat air freshener 10 may be easily installed upon a conventional toilet 14 without a substantial modification of either the toilet or the surrounding bathroom area. The toilet seat air freshener 10 is operable to eliminate unpleasant odors associated with a toilet by intaking such odors at or approximate to the source thereof, removing such odors, and returning the air to the surrounding toilet area.

Figure 5:
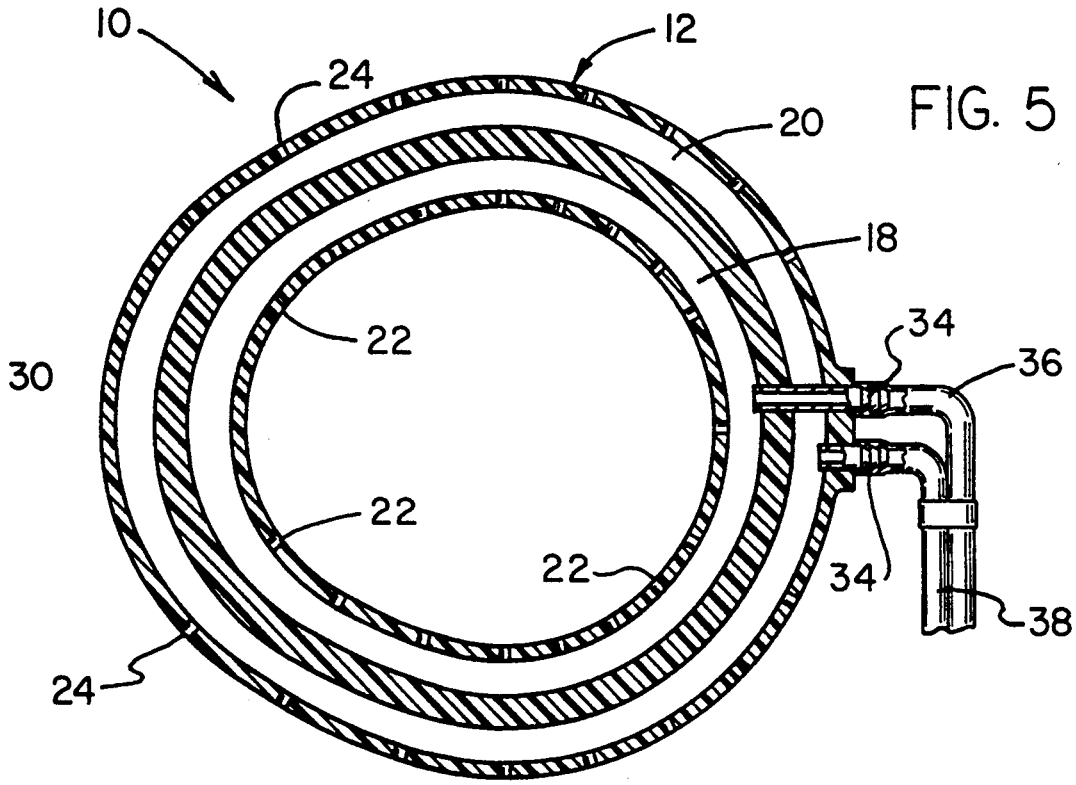
FIG. 5 is a cross sectional view taken along line 5—5 of FIG. 3.

More specifically, it will be noted that the toilet seat air freshener 10 comprises an apertured seat assembly 12 in which a seat 30 and a lid 16 are pivotally mounted together by a mounting hinge 32 which further serves to secure the apertured seat assembly 12 to a toilet 14 in a conventional manner. The seat 30 is substantially round in shape and is provided with an intake port 18 and an exhaust port 20 concentrically positioned therewithin, as best illustrated in FIG. 5. Each port 18, 20 is provided with respective intake apertures 22 and exhaust apertures 24 which communicate the ports with the interior and exterior of the seat 30, respectively.

The intake apertures 22 are positioned around an inner periphery of the seat 30 and are arranged to point toward a center of the toilet bowl, thereby to draw in noxious toilet air from the source. The exhaust apertures 24 are arranged around the outer periphery of the seat 30 and point radially outward. The apertured seat assembly 12 may include any conceivable number of intake and exhaust apertures deemed necessary for performing this function.

The intake and exhaust ports 18, 20 are each provided with couplings 34 which facilitate connection of air lines 28 thereto. The air lines 28 include an intake line 36 and an exhaust line 38, as best illustrated in FIG. 3. The lines 36, 38 comprise a flexible or rigid tubing and are of a length sufficient to allow connection to an air treatment assembly 26 which may be positioned immediately adjacent to or behind the toilet 14, as best illustrated in FIG. 1.

Figure 6:
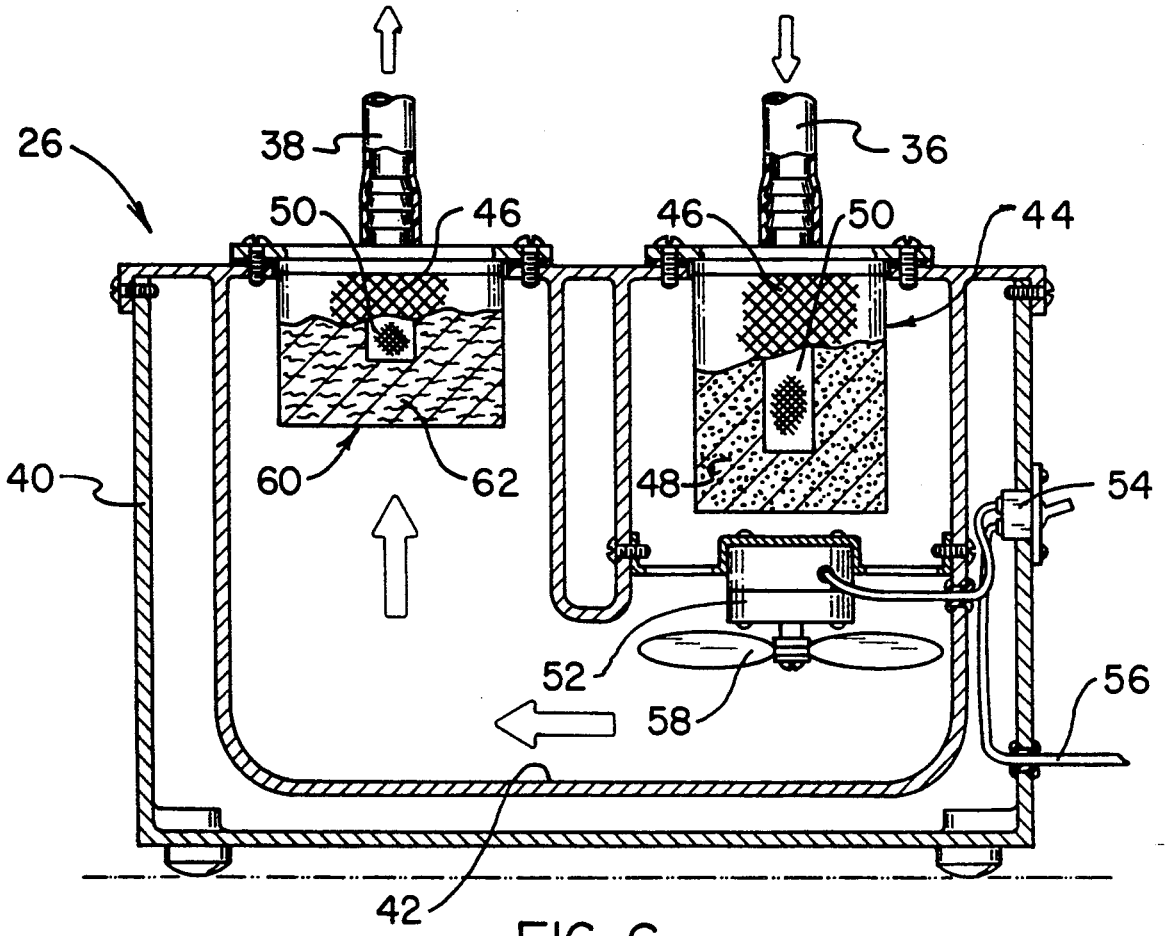
FIG. 6 is an enlarged cross sectional view of a portion of the invention taken along line 6—6 of FIG. 3.

FIG. 6 illustrates an interior of the air treatment assembly 26 and it can be seen from this Figure that the same includes a housing 40 having a substantially rectangular cross section and defining an interior chamber 42 therewithin. The interior chamber 42 is substantially U-shaped to define unlabeled intake and exhaust sides thereof.

An air filter 44 is removably positioned within the intake side of the interior chamber 42 and is connected to the intake line 36. The air filter 44 includes a mesh container 46 which contains a filtering material such as activated charcoal 48. Within a center of the activated charcoal 48 is a concentrically positioned mesh filter 50 which cooperates with the mesh container 46 to keep the charcoal contained therein. The construction of the air filter 44 is such as that the activated charcoal 48 may be replaced or, alternatively, the air filter may be manufactured as a replaceable cartridge, whereby the mesh container 46, the charcoal 48, and the mesh filter 50 are replaced as a unit.

Positioned below the air filter 44 upon an unlabeled support bracket is a motor 52 which is electrically connected to a switch 54 and a power cord 56 which allow the motor to be energized through a conventional household electrical socket. A fan 58 is coupled to the motor 52 such that an energization thereof will cause air to be drawn in through the intake line 36 and into the interior chamber 42. The motor 52 is of a conventional design and may be a variable speed motor to provide for adjustable performance thereof.

The air drawn in through the intake line 36 passes through the interior chamber 42 and exits through the exhaust line 38. An air freshener 60 is mounted within the exhaust side of the interior chamber 42 such that the air must pass through a deodorant material 62 prior to its exhaust therefrom. The air freshener 60 is similar in construction to the air filter 44 and utilizes a mesh filter 50 concentrically positioned within a mesh container 46, whereby the deodorant material 62 is positioned therebetween. The air freshener 60 may be similarly constructed as a replaceable cartridge such that the deodorant material 62 may be easily replaced.

In use, the toilet seat air freshener 10 may be easily installed upon a conventional toilet 10 without a substantial modification of the toilet or the surrounding bathroom area. The toilet seat air freshener 10 is operable to eliminate unpleasant odors associated with a toilet by intaking such odors at or proximate to the source thereof, removing such odors, and returning the air to the surrounding area.

Figure 7:
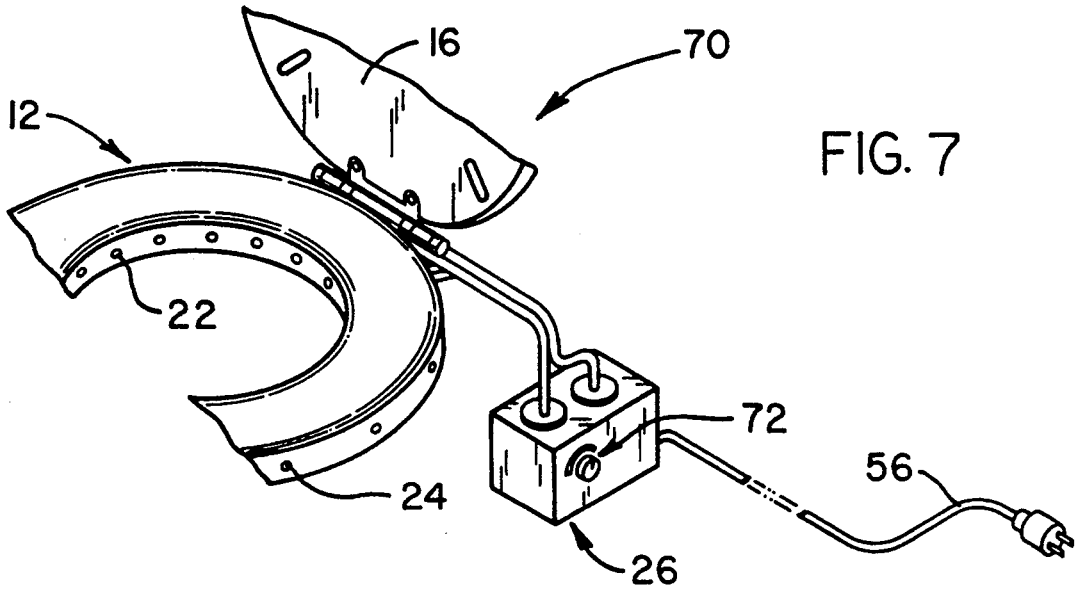
FIG. 7 is a perspective view of a second embodiment of a toilet seat air freshener comprises of the present invention.
Figure 8:
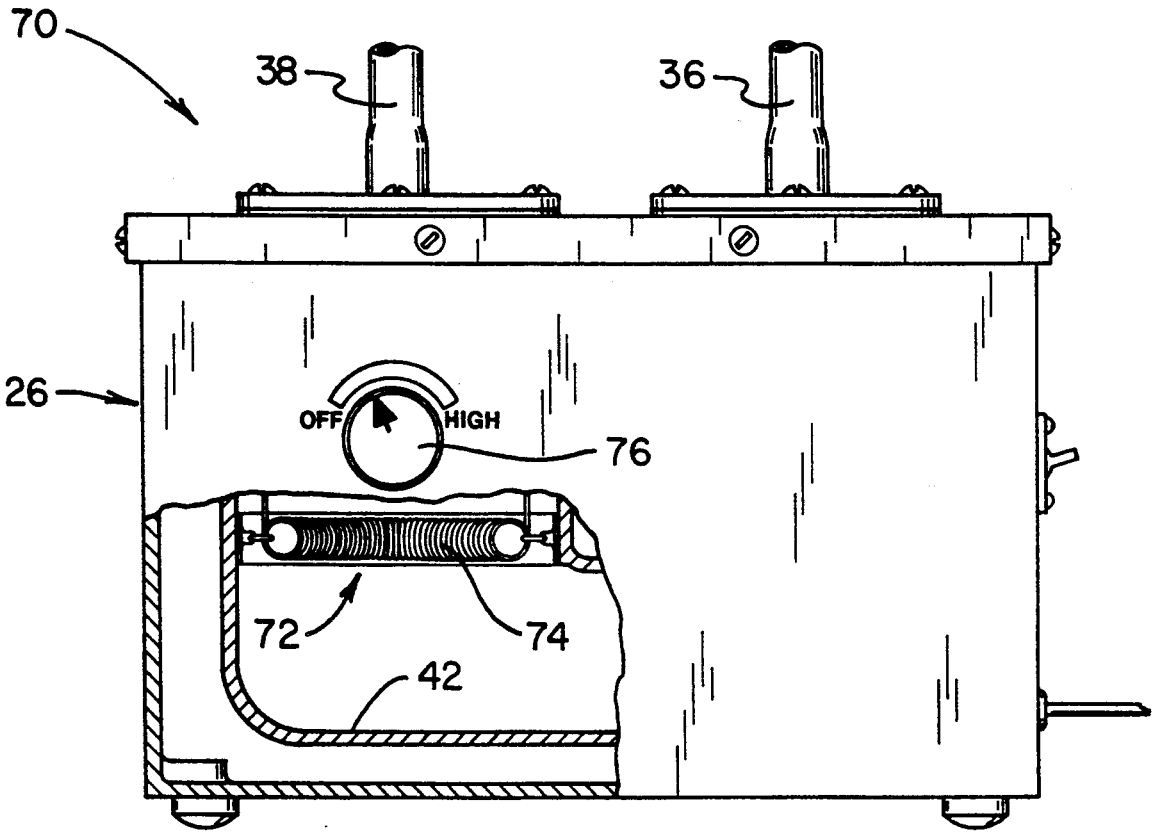
FIG. 8 is a side elevation view, partially in cross section, of a portion of the second embodiment.

A second embodiment of the present invention, as generally designated by the reference numeral 70, which comprises substantially all of the features and structure of the foregoing embodiment 10 and which further comprises a heater assembly 72 will now be described. As best shown in FIGS. 7–8, it can be shown that the heater assembly 72 may be included within the air treatment assembly 26 to heat the filtered air prior to its exhaust through the exhaust apertures 24. The heater assembly 72 includes a heating coil 74 positioned within the interior chamber 42 the air freshener 60. The heating coil 74 is electrically connected to both a conventional thermostat 76 and the power cord 56. The thermostat 76 allows a user to control the energization of the heating coil 74, thereby effectively regulating the temperature of the air being exhausted through the exhaust apertures 24.

As air is drawn in through the intake apertures 22, air from the surrounding exterior area of the apertured seat assembly 12 will be drawn into the bowl area, thereby changing and typically reducing the temperature within the bowl area. The heater assembly 72 effectively raises the temperature of the air exhausted through the exhaust apertures 24 and such air is then drawn back into the bowl area as a result of the pressure differences created by the intake of air as described above. Thusly, the heater assembly 72 effectively eliminates the drafty feeling which may occur as a result of the associated air movement.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new toilet seat air freshener comprising:

a toilet seat having an inner periphery, defining an opening through said seat for deposition of waste matter, and an outer periphery, said inner and outer peripheries bounding an upper seating surface and an opposed lower surface, said seat having an intake port and an exhaust port extending interiorly therearound, said intake port being concentrically positioned with respect to said exhaust port, said intake port having a plurality of intake apertures positioned around said inner periphery of said seat, and said exhaust port having a plurality of exhaust apertures positioned around said outer periphery of said seat;

and, an air treatment means in fluid communication with said ports for drawing air into said intake port through said intake apertures, to said air treatment means for treating said air to remove odors therefrom, and subsequently routing said treated air to said exhaust port for passage to the area surrounding said seat via said exhaust apertures.

2. The new toilet seat air freshener of claim 1, wherein said air treatment means additionally freshens said air.

3. The new toilet seat air freshener of claim 2, wherein said air treatment means comprises:

a housing;

and interior chamber extending through said housing to define an intake side and an exhaust side;

an air filter positioned within said interior chamber, said air filter being in fluid communication with said intake port;

air moving means for moving air through said interior chambers;

and, an air freshener positioned within said interior chamber, said air freshener being in fluid communication with said exhaust port.

4. The new toilet seat air freshener of claim 3, wherein said moving air moving means comprises:

a motor positioned within said interior chamber;

a fan coupled to said motor;

cord means for coupling said motor to a power source;

and, switch means for selectively energizing said motor.

5. The new toilet seat air freshener of claim 1, and further comprising a heater means in fluid communication with said air treatment means for heating said air.

6. The new toilet seat air freshener of claim 5, wherein said air treatment means additionally freshens said air.

7. The new toilet seat air freshener of claim 6, wherein said air treatment means comprises:

a housing;

an interior chamber extending through said housing to define an intake side and an exhaust side;

an air filter positioned within said interior chamber, said air filter being in fluid communication with said intake port;

a motor positioned within said interior chamber;

a fan coupled to said motor;

cord means for coupling said motor to a power source;

switch means for selectively energizing said motor;

an air freshener positioned within said interior chamber, said air freshener being in fluid communication with said exhaust port;

and, a heating coil positioned within said interior chamber, said heating coil being in electrical communication with said cord means.

* * * * *